US007181810B2

(12) United States Patent
Fernando

(10) Patent No.: US 7,181,810 B2
(45) Date of Patent: Feb. 27, 2007

(54) SLIDE FASTENER

(76) Inventor: Semage Rupasiri Fernando, 4 Rosemount Road, Glenrothes, Fife (GB) KY6 2QF ( * ) Notice: Subject to any disclaimer, the term of this patent is extended or adjusted under 35 U.S.C. 154(b) by 0 days.

(21) Appl. No.: 11/301,209

(22) Filed: Dec. 12, 2005

(65) Prior Publication Data

US 2006/0090306 A1 May 4, 2006

Related U.S. Application Data

(63) Continuation of application No. 10/470,203, filed as application No. PCT/GB02/00323 on Jan. 24, 2002, now abandoned.

(30) Foreign Application Priority Data

Jan. 27, 2001 (GB) ..... 0102142.7

(51) Int. Cl.
*A44B 19/42* (2006.01)

(52) U.S. Cl. ..... 24/389

(58) Field of Classification Search ..... 24/384, 24/389, 403, 405, 410, 411
See application file for complete search history.

(56) References Cited

U.S. PATENT DOCUMENTS

| | | | | |
|---|---|---|---|---|
| 3,111,738 A | | 11/1963 | Bair | 24/205.1 |
| 3,389,441 A | * | 6/1968 | Heimberger | 24/389 |
| 3,490,109 A | | 1/1970 | Heimberger | 24/205.1 |
| 3,501,816 A | | 3/1970 | Heimberger | 24/205.1 |
| 3,668,745 A | | 6/1972 | Krupp | 24/205.1 |
| 4,596,065 A | | 6/1986 | Tanikawa et al. | 24/389 |
| 4,607,416 A | | 8/1986 | Tanikawa et al. | 24/384 |
| 4,724,586 A | | 2/1988 | Tsubokawa et al. | 24/384 |
| 4,765,038 A | | 8/1988 | Kasai | 24/389 |
| 4,823,446 A | | 4/1989 | Tsubata et al. | 24/389 |
| 4,922,585 A | * | 5/1990 | Suzuki et al. | 24/381 |
| 4,922,858 A | | 5/1990 | Ahrens | 119/73 |
| 5,008,986 A | | 4/1991 | Laudet et al. | 24/289 |
| 5,386,616 A | | 2/1995 | Norvell | 24/389 |
| 6,092,266 A | | 7/2000 | Lee | 24/389 |

(Continued)

FOREIGN PATENT DOCUMENTS

| | | |
|---|---|---|
| CH | 402487 | 11/1965 |

(Continued)

*Primary Examiner*—Jack W. Lavinder
(74) *Attorney, Agent, or Firm*—Young & Basile, P.C.

(57) ABSTRACT

The present invention relates to a slide fastener suitable for providing a water resistant closure between two edges of material. The fastener comprises first and second stringer tapes, each stringer tape having a multiplicity of coupling elements disposed in a row therealong and a slider captively engaged with the opposed rows of coupling elements of the first and second stringer tapes for reciprocal movement therealong and for bringing the coupling elements into and out of interlocking engagement. The slide fastener is provided with an elongate length of water resistant film, which extends longitudinally of at least one face of each of the first and second stringer tapes at least along a coupling element anchoring zone and across at least a root portion of coupling element receiving recesses defined by neighbouring coupling elements so as to provide web portions between neighbouring coupling elements whereby the web portions abut against and conform when the slide fastener is in a closed position, so as to provide a water resistant seal against the front faces of the coupling elements.

19 Claims, 5 Drawing Sheets

U.S. PATENT DOCUMENTS 6,343,408 B1 2/2002 Neugebauer ..... 24/389

FOREIGN PATENT DOCUMENTS

| | | | |
|---|---|---|---|
| EP | 345799 | A1 | 12/1989 |
| FR | 2646760 | | 11/1990 |
| GB | 1130418 | | 6/1967 |
| GB | 1318360 | | 8/1970 |
| GB | 1345613 | | 5/1971 |
| GB | 2158506 | A | 11/1985 |

* cited by examiner

SLIDE FASTENER

RELATED APPLICATION

This application is a continuation of U.S. application Ser. No. 10/470,203 field Jul. 24, 2003 now abandoned, which is a 371 of PCT/GB02/00323, field Jan. 24, 2002.

FIELD OF THE INVENTION

The present invention relates to improvements in or relating to slide fasteners, and a method for producing such fasteners. More particularly the present invention relates to water-resistant slide fasteners.

BACKGROUND OF THE INVENTION

Slide fasteners are every-day items commonly referred to as zip fasteners, zippers or zips. By far the most common application of slide fasteners is as closure devices for bringing and retaining together two portions of clothing. With certain types of clothing such as foul weather gear, motorcycle clothing, hiking/mountaineering gear and the like it is desirable that the slide fasteners should have a degree of water resistance.

A number of water-resistant slide fasteners are known. For example, EP 0 345 799 A1 discloses a water-resistant slide fastener which is effectively a "double zip" having two superimposed pairs of coiled-type coupling elements, each pair of coupling elements being attached to a single stringer tape. This type of arrangement is relatively complex to make compared to a "standard" single slide-fastener arrangement. Moreover, the provision of a "double zip" arrangement tends to make the slide fastener of EP 0 345 799 A1 cumbersome to use as a result of the extra stiffness arising from two pairs of coupling elements in this arrangement.

GB 1,130,418 discloses a process for making a fluid-tight slide fastener wherein a conventional helical-coiled coupling element arrangement is subjected to an additional moulding process to produce two adjoined sealing strips along opposing rows of the helical-coil coupling elements. The sealing strips then are separated by a further process step of cutting the sealing strips using a blade. The process of GB 1,130,418 is relatively complex and requires a number of process steps and tooling requirements such as the provision of a cutting device to enable separating of the sealing strips which allows the slide fastener to be opened and closed ("unzipped" and "zipped").

U.S. Pat. No. 4,724,586 discloses a water-resistant slide fastener comprising a conventional helical coil slide fastener having a pair of elongate reinforcing cores extending through the helical coil, and pair of stringer tapes to which the helical coil and reinforcing cores are stitched. The stringer tapes each have an extended lower margin which abuts against a corresponding lower margin of the opposing stringer tape so that when the slide fastener is in a closed condition, the extended lower margins of stringer tape press against one another to form a water-resistant seal therebetween.

The slide fastener of U.S. Pat. No. 4,724,586 requires a number of extra components e.g. the reinforcing cores to be provided in addition to a standard helical coil fastener.

SUMMARY OF THE INVENTION

It is an object of the present invention to obviate and/or minimise one or more of the disadvantages of the devices and/or methods of manufacture of the prior art by providing a water-resistant slide fastener and a method of manufacture therefor.

The present invention provides a slide fastener suitable for providing a water-resistant closure between two edges of material wherein the fastener comprises:

first and second stringer tapes, each stringer tape having an upper and a lower surface, and an inner edge portion extending along the length thereof, wherein the inner edge portions of the first and second stringer tapes are arranged to oppose one another;

each said stringer tape having a multiplicity of coupling elements disposed in a row along the corresponding inner edge portion thereof;

a slider captively engaged with opposed rows of coupling elements of the first and second stringer tapes for reciprocal movement therealong, for bringing the coupling elements of the first stringer tape into and out of interlocking interengagement between pairs of adjacent coupling elements on the second stringer tape and vice versa as parts of the slide fastener are brought into closed and open conditions respectively; characterised in that:

the slide fastener is provided with an elongate web of water-resistant film which extends longitudinally of at least one face of each of the first and second stringer tapes at least along a coupling element anchoring zone thereof and across at least a root portion of coupling element receiving recesses defined between neighbouring coupling elements so as to provide web portions between said neighbouring coupling elements, which web portions abut against and conform about at least a front face of the respective coupling element interlocked between said neighbouring coupling elements when the slide fastener is in the closed condition so that the web portions form a water-resistant seal against the front faces of the coupling elements abutting thereagainst.

The present invention also provides a method of manufacturing a stringer tape suitable for use in a water-resistant slide fastener comprising the steps of:

(a) providing a stringer tape having a multiplicity of coupling elements arranged in a row along an inner edge portion thereof, wherein the stringer tape comprises a coupling element anchoring zone and adjacent coupling elements have coupling element receiving recesses defined therebetween and each coupling element receiving recess has a root portion adjacent said inner edge portion;

(b) providing a length of water-resistant film;

(c) aligning the film along the stringer tape and row of coupling elements so that the film extends over the coupling element anchoring zone and the faces of the coupling elements adjacent the recess root portions; and (d) bringing the coupling element anchoring zone of the stringer tape and a face of each of the coupling elements adjacent the recess root portions together with the film and bonding the film to the stringer tape and the faces of the coupling elements to form web portions extending between neighbouring coupling elements at least across the root portion of said recesses.

Conveniently in a preferred embodiment a layer of adhesive material(s) desirably thermal bonding adhesive(s) is provided between at least the coupling element anchoring zone and the film and between the film and a face of the row of coupling elements adjacent at least the root portion of said recesses. Desirably there may be used two layers of adhesive (preferably a contact/hot melt adhesive)—one on the film and one on the anchoring zone/stringer tape.

The slide fastener of the present invention provides a water-resistant closure which is very similar in general appearance to standard slide fasteners, but is much simpler in construction and manufacture than many prior art water-resistant devices thereby having lower costs associated with materials, tooling and/or labour in the production thereof. Additionally, the slide fastener of the present invention does not have additional flaps or layers of material or tape which may limit the types of application or clothing with which the slide fastener can be used or attached to.

The first and second stringer tapes are generally in the form of elongate, substantially rectangular strips of material. The material may be woven or non-woven. Preferably, the material is water-resistant but this is not necessary—especially where the water resistant film extends across parts of the stringer tape which would be exposed in use. The inner edge portions of the stringer tapes provide an anchoring zone for the coupling elements while outer edge portions of the stringer tapes provide an anchoring zone for attachment of the slide fastener to an item of clothing or other article at opposed sides of an opening therein, for example, by means of stitching, adhesive, thermal bonding, etc.

It is intended that the term "water-resistant" refers to the ability of the slide fastener to resist against the penetration of water which is splashed onto the slide fastener and also includes resistance against water penetration where the slide fastener and, for example, an article of clothing to which it is attached, are momentarily submerged underwater or exposed for longer periods of time in relatively shallow e.g. 10 cm bodies of water such as streams. In this connection the term "water-resistant" would not normally include the ability to resist water penetration in prolonged submersion activities such as use in wet/dry suits.

The stringer tape material may be formed of any suitable natural or synthetic material but are conveniently a synthetic polymer material such as P.V.C., polyethylene, polypropylene, synthetic rubber, polyurethane and other such materials commonly used as water resistant materials for clothing.

The at least one face of each of the first and second stringer tapes may be the upper or lower face or surface adjoining the anchoring zone of the coupling elements where the upper face is the outer or exposed face. Preferably both the "upper" and "lower" faces of the stringer tapes are coated with said elongate web of film.

The coupling element receiving recesses defined between neighbouring couplings are zones or areas between neighbouring coupling elements anchored to a first stringer tape which recesses are formed and arranged to receive and captively retain therein a coupling element anchored to a second stringer tape, when the slide fastener is in a closed condition. The root portion of the coupling element receiving recess is the base or innermost part of the recess proximate the inner edge portions of the first and second stringer tapes. Preferably, when in a closed condition, the front faces of the coupling elements disposed on an opposing (first or second) stringer tape extends towards and abut against the web portions at least to the root portions of the corresponding coupling element receiving recesses.

Each row of coupling elements may be formed from conventional helically coiled coupling elements, where individual coupling elements are formed by each consecutive full rotation of a helical coil. The helically coiled coupling elements may be sewn, glued or otherwise bonded to the stringer tapes. Alternatively, the coupling elements may be formed from individual teeth of conventional design wherein the individual teeth may be sewn, glued or otherwise bonded to the stringer tapes in a manner known to those skilled in the art thereof. The individual teeth may be formed by a moulding or other similar process. Alternatively the coupling elements and the first and second stringer tapes are moulded in one piece.

It is preferred that the coupling elements are of the individual moulded type, as helical coil-type coupling elements are susceptible to opening up gaps between the coupling elements of the first and second stringer tapes when a large transverse force is applied across the slide fasteners incorporating such coupling elements.

The slider may be a conventional slider generally comprising an upper wing having a pair of opposing downwardly directed side flanges and a lower wing having a pair of opposing upwardly directed side flanges where the wings are joined to one another by a wedge shaped portion extending therebetween to define a generally Y-shaped opening for reciprocal movement of the slider along the coupling elements to open and close the slide fastener. The slider is preferably provided with a finger grip portion to facilitate moving the slider. Desirably the finger grip portion is hingably mounted on the slider. The elongate web of water-resistant film preferably coats at least a portion of the upper or outer (in use) surface of the first and second stringer tapes and the rows of coupling elements thereon. In one particularly preferred embodiment, the film extends over a major portion of the upper surface of the coupling elements and is bonded thereto only at a portion adjacent the root portion.

The water-resistant material forming the film may be any suitable natural or synthetic water-resistant material such as for example natural or synthetic rubber, P.V.C., polyester, polyurethane or combinations thereof which has, when bonded to the slide fastener, sufficient mechanical resilience and elastic properties to be able to be deformed a very large number of times without failure. This is particularly relevant as the film web portions, when the slide fastener is in a closed condition, abut against, and deform to form a water-resistant seal against the front faces of the coupling elements.

The film is preferably bonded to the stringer tapes and the coupling elements by an adhesive material disposed in a layer or layers therebetween. Desirably the adhesive material is a layer of hot melt adhesive or hot melt contact adhesive. It will be appreciated that the adhesive material should be compatible with the materials from which the stringer and coupling elements are formed, in addition to not failing under moist or wet conditions of use of the slide fastener.

Preferably, the film has an upstanding lip or flange portion extending along a free edge of at least the web portions, and most preferably along the entire length of the film. A lip/flange portion provided on the first stringer tape is generally formed and arranged to abut against a corresponding lip/flange portion provided on the second stringer tape so as to form a water-resistant seal between the abutting lip/flange portions when the slide fastener is in a closed condition.

The film may be of any desired thickness depending upon the use requirements of the slide fastener. For example, where an article of clothing to which a slide fastener is to be attached is relatively light and/or is intended only to have a minimum of water-resistance such as for light shower-proof applications, then a relatively thin outer-wear film of approximately 20 μm could be used. For heavier applications such as sports bags, hold-alls, outer-wear for emergency and rescue services a thicker film of approximately 100 μm could be used. In general the film desirably has a thickness of from 10 to 150 μm, preferably from 15 to 120 μm and most preferably from 30 to 80 μm, advantageously from 40 to 60 μm. In some applications such as for example ski-wear a film thickness of about 40 μm is desirable.

Advantageously the film may also be applied to the lower surface of the stringer tapes, and, if desired, across at least part of the coupling elements and recesses therebetween, at that side of the stringer tapes.

Desirably the film is applied to both the upper and lower surfaces of the stringer tapes and coupling elements. This arrangement provides an extra degree of water-resistance which would be advantageous in heavier duty applications such as foul weather gear and survival gear including applications where prolonged immersion in water is usual.

In another aspect, the present invention provides a method of producing a water-resistant slide fastener, the method comprising the steps of:

(a) providing a slide fastener comprising first and second stringer tapes, each stringer tape having a multiplicity of coupling elements in a row extending along an inner edge portion thereof;

(b) providing a length of water-resistant film;

(c) aligning the film along the stringer tape and row of coupling elements so that the film extends over the coupling element anchoring zone and the faces of the coupling elements adjacent the recess root portions; and (d) bringing the coupling element anchoring zone of the stringer tape and the faces of the coupling elements adjacent the recess root portions together with the film and bonding the film to form web portions extending between neighbouring coupling elements at at least the root portions of said recesses;

(e) aligning the respective inner edge portions of the first and second stringer tapes to oppose one another;

(f) providing a slider; and (g) mounting the slider on the rows of coupling elements such that the slider is captively engaged therewith for reciprocal movement therealong.

Desirably a layer (or layers) of adhesive material is located between at least the coupling element anchoring zone and the film and between the film and a face of the row of coupling elements adjacent at least the root portions of said recesses used to bond the film to the stringer tapes and the coupling elements.

In a preferred method of producing a stringer tape and coupling elements suitable for use in a water-resistant slide fastener there is used a hot-melt adhesive (or adhesives) and the method of the invention also includes the steps of:

providing a layer of hot-melt adhesive (or adhesives) on a face of the water-resistant film; and applying heat to at least one of the stringer elements and the water-resistant film, before applying each length of film to the stringer tapes and the coupling elements, anchored thereto.

The stringer tapes and coupling elements may be heated by a hot air gun or similar device. To ensure that the film bonds strongly with the stringer tapes and coupling elements, it is preferred that immediately after the film has been applied to the stringer tapes and coupling elements that the slide fastener pass through a former tool which presses the film into contact with the stringer tapes and coupling elements.

The heat required to melt the hot melt adhesive (where used), is conveniently provided by heating the former tool.

The former tool preferably comprises one or more rollers having a profile substantially complementary to that of the stringer tapes and coupling elements thereon to ensure that an even pressure is applied to the film as the film and stringer tapes (and coupling elements) pass through the former tool. Desirably, the former tool is profiled at one end to form the upstanding lip or flange portion on the film.

The lengths of water-resistant film may be discrete lengths of a predetermined length or longitudinal extent, for example, for use in coating individual ones of a said stringer tape and a row of coupling elements thereon. Alternatively, the lengths may be a substantially continuous length of said film provided, for example, in the form of a substantially continuous roll of film.

BRIEF DESCRIPTION OF THE DRAWING

Further preferred features and advantages of the present invention will appear from the following detailed description given by way of example of some preferred embodiments illustrated with reference to the accompanying drawings in which.

DETAILED DESCRIPTION

Figure 1:
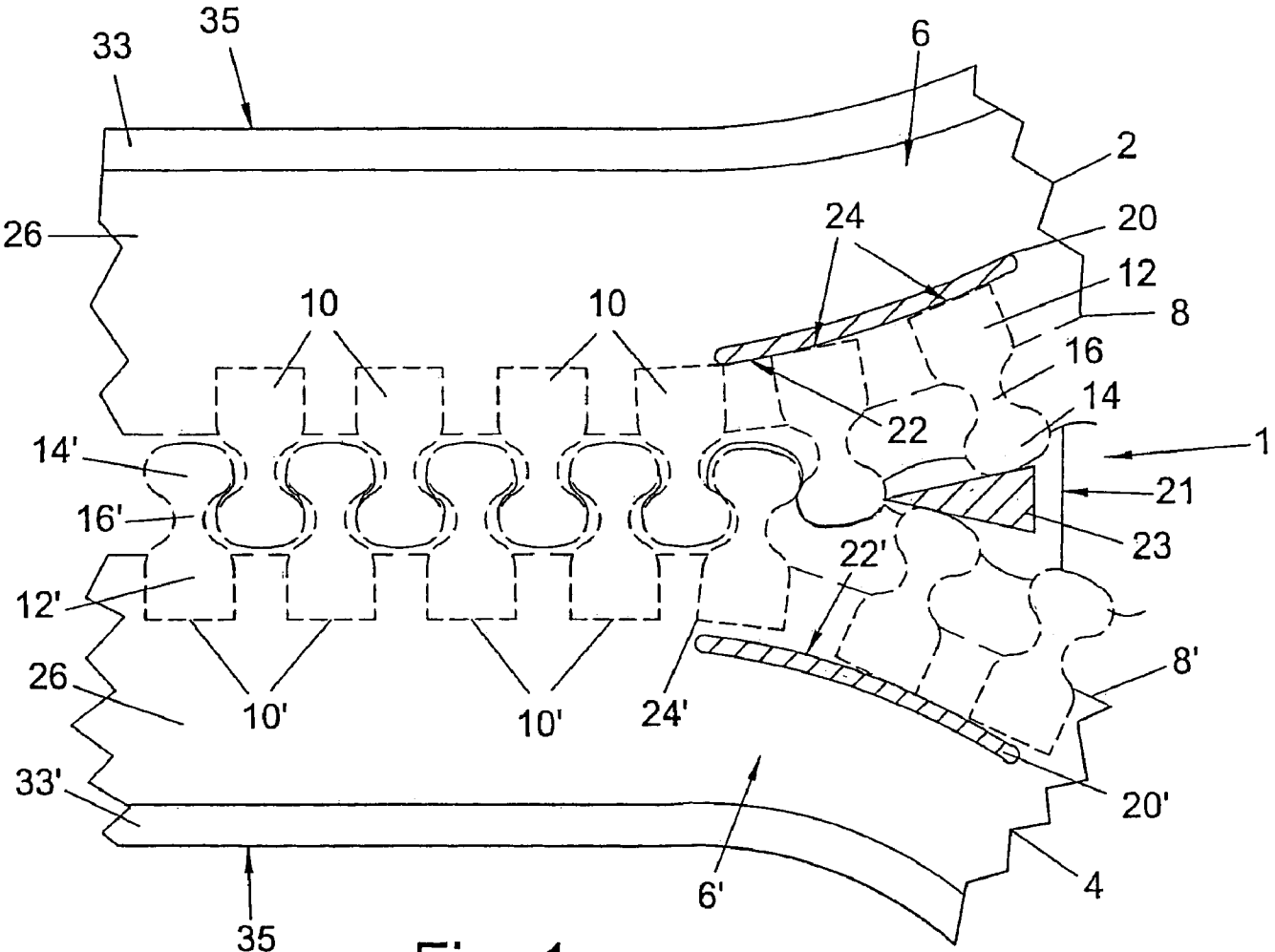
FIG. 1 shows a top view of a slide fastener according to a first embodiment of the present invention, with a section through a slider thereon.

A slide fastener in a closed condition according to a first embodiment of the present invention is shown in FIG. 1 and is generally designated by the reference number 1.

The slide fastener 1 has a pair of parallel and longitudinally extending first and second stringer tapes 2, 4 formed from elongate strips of woven nylon fabric. Each stringer tape 2, 4 has an upper surface 6, 6' and a lower surface (not shown). The stringer tapes 2, 4 have inner edges 8, 8' which extend along the length of each stringer tape 2, 4. The inner edges 8, 8' are arranged to oppose one another on the stinger tapes 2, 4.

Each stringer tape 2, 4 has a plurality of individual teeth 10, 10' arranged along the inner edges 8, 8'. Each tooth 10, 10' has a square shaped anchor portion 12, 12' and a round head portion 14, 14' joined to one another by a relatively narrow neck portion 16, 16'. Each tooth 10, 10' is of the moulded plastic type and is bonded to the stringer tapes 2, 4 at the anchor portion 12, 12'.

Figure 2:
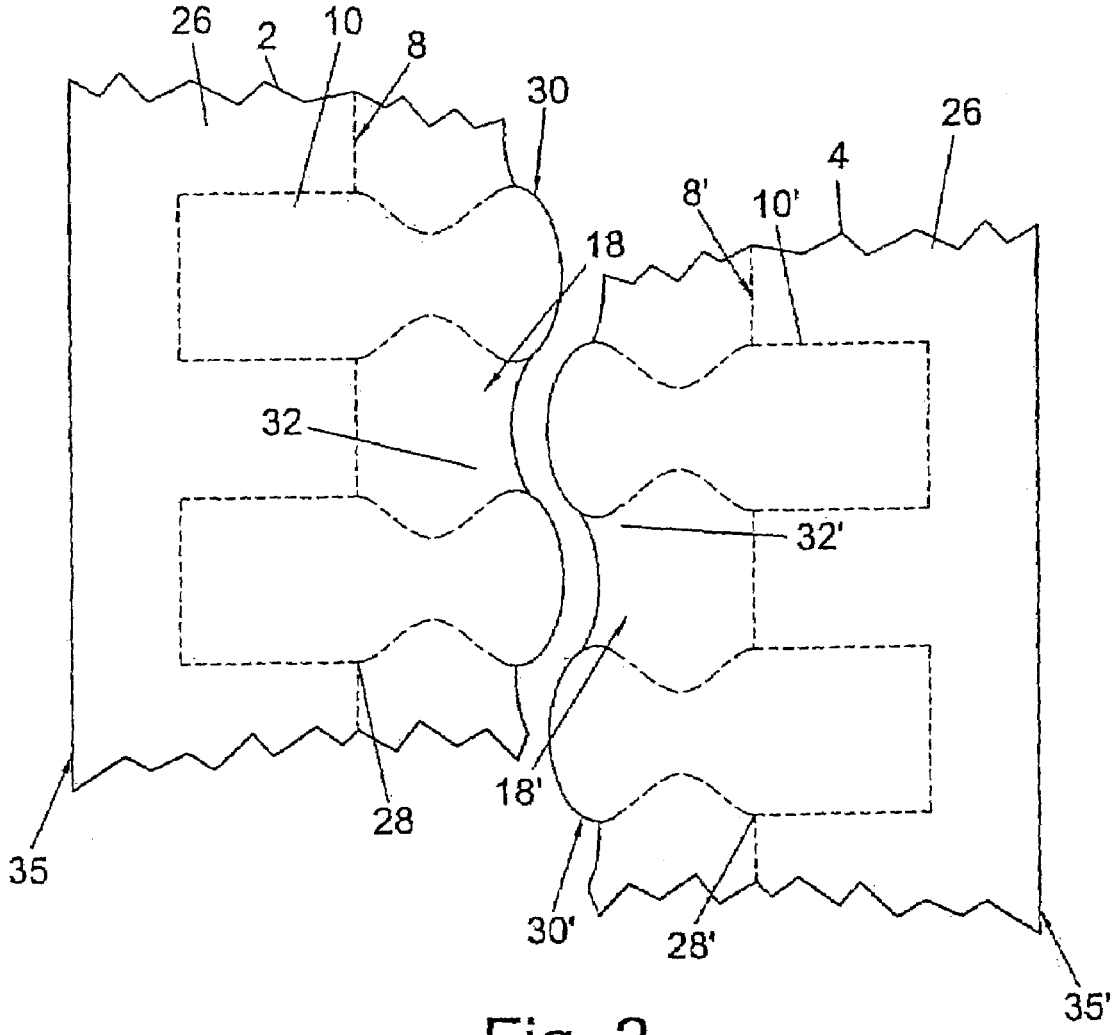
FIG. 2 shows a more detailed view of the slide fastener of FIG. 1 in an open condition.

The areas or zones between adjacent teeth on each stringer tape 2, 4 are referred to as the coupling element or tooth receiving recesses 18, 18' (FIG. 2). When the slide fastener 1 is in the closed condition (FIG. 3) the head portion 14 of the first stringer tape 2 is located and retained in the tooth receiving recess 18' between two adjacent teeth 10' on the second stringer tape 4, and vice versa.

A slider is mounted on the rows of teeth 10, 10' in FIG. 1. The slider comprises an upper wing (not shown) having a pair of opposing inwardly curved downwardly directed side flanges 20, 20'. Similarly, a lower wing 21 having a pair of flanges are provided on an underside of the slider. The upper and lower wings are joined to one another by a wedged shaped (shown in section) divider 23. An inner face 22, 22' of each flange 20, 20' abuts against a rear face 24, 24' of the anchor portion 12, 12' of each tooth 10, 10' so that when the slider is moved (by hand) reciprocally back and forth along the rows of teeth 10, 10', the teeth 10, 10' are brought into and out of interlocking engagement with one another wherein the divider 23 facilitates separation of the teeth 10, 10' to leave the slide fastener 1 in an open condition. In this respect the slide fastener 1 of the present invention operates in the same way as a conventional zipper or slide fastener.

Figure 3:
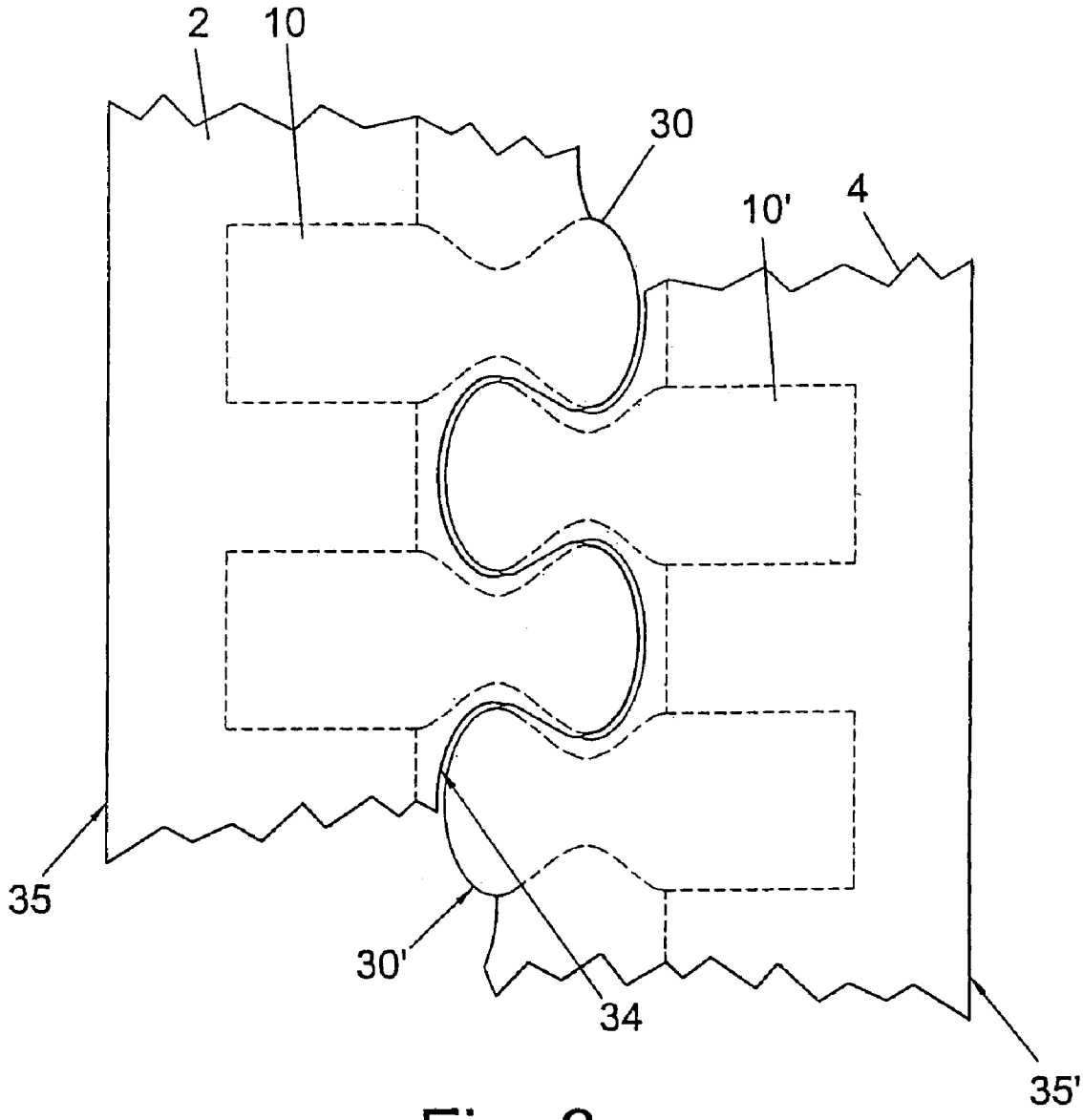
FIG. 3 shows the slide fastener of FIG. 1 in a closed condition.

The upper surface 6, 6' of the stringer tapes 2, 4 and the teeth 10, 10' are coated with a layer of flexible water-resistant film 26 (see particularly FIGS. 2 and 3). The film 26 extends between adjacent teeth on each of the stringer tapes 10, 10' from a root portion 28, 28' adjacent the inner edges 8, 8' of the stringer tapes 2, 4 within the teeth receiving recesses 18, 18' to a front face 30, 30' of the teeth 10, 10' to form a web 32, 32' extending between adjacent teeth. The film 26 is bonded to the stringer tapes 2, 4 and the teeth 10, 10' by a layer of heat activated adhesive (or adhesives) (not shown) disposed between the film 26 and the stringer 2, 4 and the teeth 10, 10'. The film 26 extends to the outer edge 35, 35' of the first and second stringer tapes 2, 4.

When in a closed condition as shown in FIG. 3, the front faces 30, 30' of the teeth 10, 10' are forced into the tooth receiving recesses 18', 18 respectively. The front faces 30, 30' abut against and compress the webs 32', 32 respectively to form a water-resistant seal 34 therebetween.

The material (which can be PVC (plasticised or unplasticised), polyethylene, polyurethane, etc) from which the film 26 is formed is resilient so that when the slide fastener 1 is in an open condition (FIG. 2), the web 32, 32' once again reverts back to its original form as shown in FIG. 2.

In a second embodiment, a slide fastener 101, in a closed condition (shown in FIG. 4) comprises a pair of stringer tapes 102, 104 each having a row of teeth 110, 110' extending along an inner edge 108, 108' thereof. Each stringer tape 102, 104 has an upper surface 106, 106' and a lower surface 107, 107'. A length of water-resistant film 128 is bonded to and extends along the length of the stringer tapes 102, 104, by a hot melt adhesive (not shown). The film 128 extends over the entire upper 106, 106' surface and is folded under the stringer tapes 102, 104 along outer edges 135, 135' thereof to extend over the lower surfaces 107, 107'. Only a relatively narrow strip (approximately $1/5^{th}$ of the width) of the lower surfaces 107, 107' adjacent a rear face 124, 124' of the teeth 110, 110' of stringer tapes 102, 104, is not covered by the film 128.

The film 128 forms a lip or flange 134, 134' extending upwardly away from an upper surface 136, 136' of the teeth 110, 110'. The lip or flange 134 of the first stringer tape 102 abuts against the lip or flange 134' of the second stringer tape 104 to form a water-resistant seal 140 therebetween when the slide fastener 101 is in a closed condition (see FIG. 4).

Figure 4:
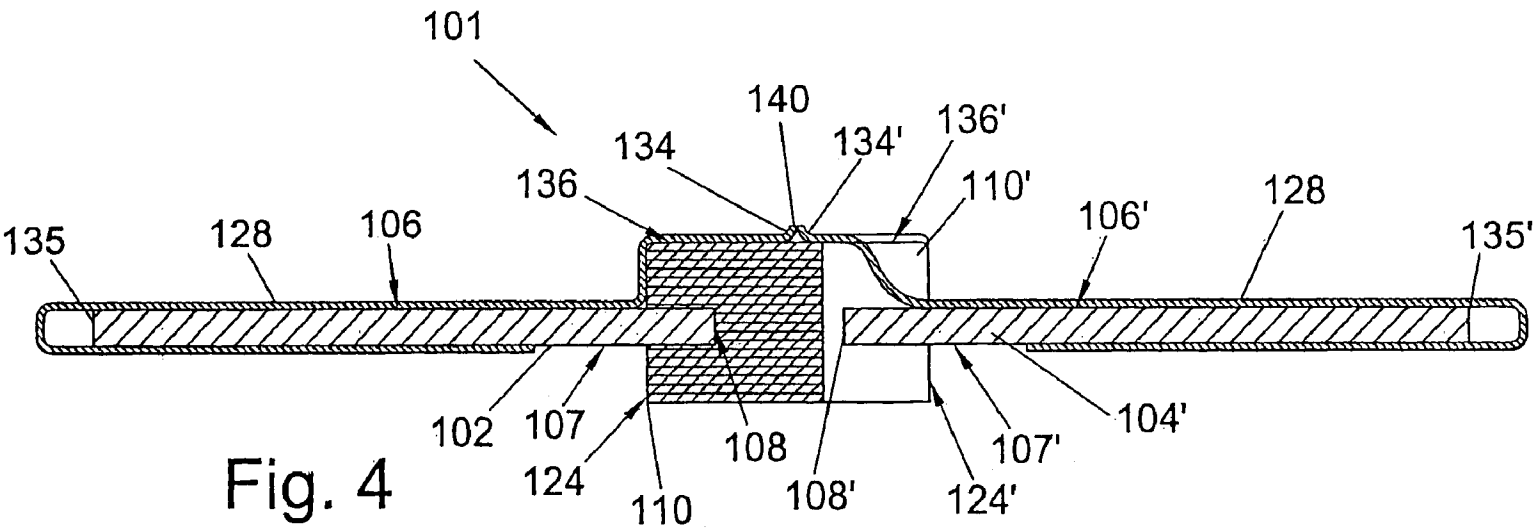
FIG. 4 shows a sectional view through a slide fastener according to a second embodiment of the present invention.
Figure 5:
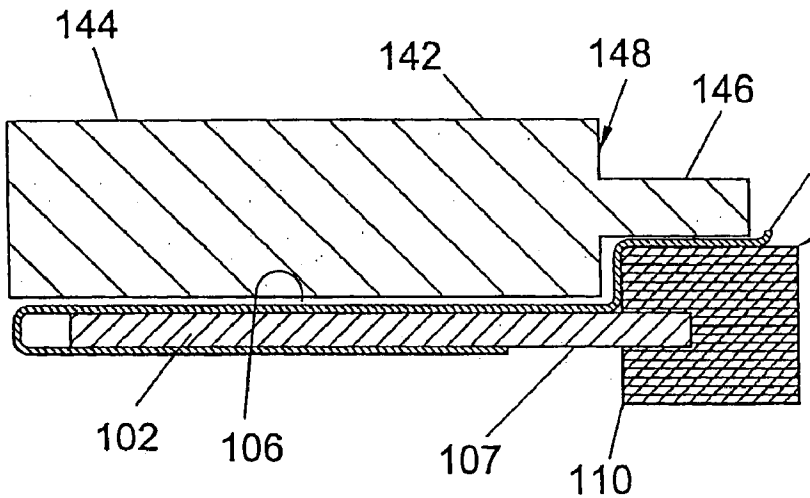
FIG. 5 shows a sectional view of one stringer tape and a row of coupling elements thereon of the slide fastener of FIG. 4, and a former tool.

FIG. 5 shows the first stringer tape 102 of FIG. 4 and a forming roller 142 which is used to press the film 128 onto the upper surface 106 of the first stringer tape 102 and the upper surface 136 of the tooth 110. The roller 142 has a relatively narrow diameter neck portion 146 extending from a first end 148. The neck portion 146 extends from the first end 148 so that in use the roller 142 presses the film 128 onto the stringer tape 102 and tooth 110 and ensures that an even pressure is applied to the upper surfaces 106, 136.

Figure 6:
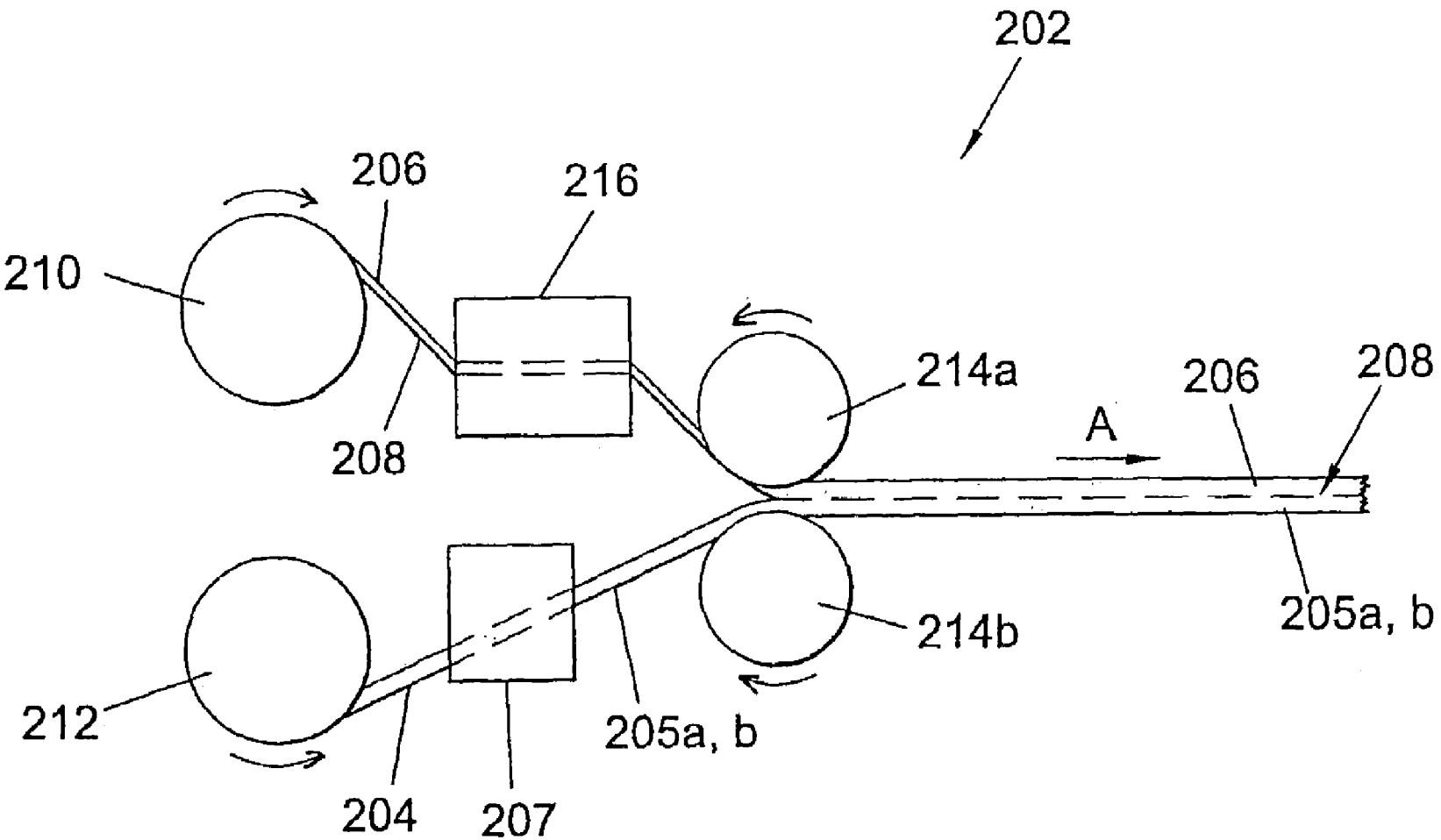
FIG. 6 shows a schematic diagram of an apparatus suitable for producing a water-resistant slide fastener according to an embodiment of the present invention.

FIG. 6 shows a schematic diagram of an apparatus 202 suitable for coating a pair of conjoined stringer tapes 204 having rows of interlocking teeth thereon (not shown) with a layer of water-resistant film 206. The apparatus 202 has a first rotatable roll 210 of a continuous length of film 206 having a layer of heat activatable adhesive 208 on a lower surface thereof. The first roll 210 is located above a second rotatable roll 212 bearing a continuous length of stringer tapes 204.

The first and second rolls 210, 212 are contra-rotated by a motor gearing system (not shown) to feed the film 206 and stringer tape 204 through two smaller pairs (only one shown) of contra-rotatable former rollers 214*a,b* which are also driven by the motor and gearing system. A hot air oven 216 (or a hot air blower or an ultrasonic unit or a high frequency unit) is disposed between the first roll 210 and the former rollers 214*a,b* such that the adhesive 208 is activated thereby. The pair of conjoined stringer tapes 204 are separated into individual stringer tapes 205*a,b* by an unzipping device 207 disposed between the roll 212 and the rollers 214*a,b* so that one of the stringer tapes 205*a* passed through one pair of former rollers, and the other stringer tape 205*a* passes through the other pair of former rollers (not shown).

The film 206 exits the oven 216 and is directed onto and pressed against the now separated stringer tapes 205*a,b* (and the teeth) by the former rollers 214*a,b* before exiting the apparatus 202 in the direction of arrow A.

The slider tapes 205*a,b* are then zipped together again into a closed condition by a closing device (not shown) to form a slide fastener suitable for attaching a slider thereto for use in articles of clothing, bags and safety equipment.

EXAMPLE 1

It has been shown by the inventor that a slide fastener according to the second embodiment of the present invention is water-resistant when submerged up to a depth of 10 cm of water for a prolonged period of time (more than 1 hour) when attached to an article of clothing. No detectable water leakage through the slide fastener was observed when the fastener was in a closed condition

EXAMPLE 2

In order to test the durability of a slide fastener according to the present invention, the slider fastener was subjected to testing by an apparatus designed to open and close (or zip and unzip) the slider fastener a great number of times in succession. The fastener was subjected to 50,000 cycles of opening and closing by the testing apparatus and subsequent visual inspection of the slide fastener revealed little or no deterioration or wear of the water-resistant film coating the fastener.

It will of course be realised that variations of such apparatus will be apparent to the skilled person, and it is intended that the present invention extend to such apparatus.

What is claimed is:

1. A slide fastener suitable for providing a water-resistant closure between two edges of material wherein the fastener comprises:

first and second stringer tapes, each stringer tape having an upper and a lower surface, and an inner edge portion extending along the length thereof, wherein the inner edge portions of the first and second stringer tapes are arranged to oppose one another;

each said stringer tape having a multiplicity of coupling elements disposed in a row along the corresponding inner edge portion thereof, wherein the coupling elements are anchored to the edge portion and project beyond it to define corresponding coupling element receiving recesses therebetween;

a slider captively engaged with opposed rows of coupling elements of the first and second stinger tapes for reciprocal movement therealong, for bringing the coupling elements of the first stringer tape into and out of interlocking interengagement between pairs of adjacent coupling elements on the second stringer tape and vice versa as parts of the slide fastener are brought into closed and open conditions respectively;

characterised in that:

the slide fastener is provided with an elongate web of water-resistant film which extends longitudinally of at least one face of each of the first and second stringer tapes at least along a coupling element anchoring zone thereof and across at least a root portion of said coupling element receiving recesses defined between neighbouring coupling elements, beyond the inner edge portion of the stringer tapes, so as to provide film web portions within said recesses between said neighbouring coupling elements, which web portions abut against and conform about at least a front end face of the respective coupling element interlocked between said neighbouring coupling elements when the slide fastener is in the closed condition so that the web portions form a water-resistant seal against the front end faces of the coupling elements abutting thereagainst.

2. A slide fastener as claimed in claim 1 wherein said inner edge portions of the stringer tapes provide an anchoring zone for the coupling elements and said outer edge portions of the string or tapes provide an anchoring zone for attachment of the slide fastener to an item of clothing, or other article, at opposed sides of an opening therein.

3. A slide fastener as claimed in claim 1 wherein said first and second stinger tapes are in the form of elongate, substantially rectangular strips of material selected from the group of natural or synthetic materials including PVC, polyethylene, polypropylene, synthetic rubber, and polyurethane.

4. A slide fastener as claimed in claim 1 wherein at least one face of each of the first and second stringer tapes is coated with said elongate web of film.

5. A slide fastener as claimed in claim 1 wherein said coupling element receiving recess is the base or innermost part of the recess proximate the inner edge portion of the first and second stringer tapes.

6. A slide fastener as claimed in claim 1 wherein in a closed condition, the front faces of the coupling elements disposed on an opposing stringer tape extend towards and abut against the web portions at least to the root portions of the corresponding coupling element receiving recesses.

7. A slide fastener as claimed in claim 1 wherein the coupling elements are selected from conventional helically coiled coupling elements, wherein individual coupling elements are formed with each consecutive full rotation of a helical coil, or from individual teeth of conventional design wherein the individual teeth are sown, glued or otherwise bonded to the stringer tape.

8. A slide fastener as claimed in claim 1 wherein said water resistant film is a natural or synthetic water resistant material selected from the group including natural or synthetic rubber, pvc, polyester, polyurethane, or combinations thereof and which has deformation failure mechanical resilience.

9. A slide fastener as claimed in claim 1 wherein said film has a thickness in the range of from 10 to 150 μm.

10. A slide fastener as claimed in claim 1 to wherein said film is applied to both surfaces of the stringer tapes and across at least part of the coupling elements and recesses therebetween.

11. A slide fastener suitable for providing a water-resistant closure between two edges of material wherein the fastener comprises:

first and second stringer tapes, each stringer tape having an upper and a lower surface, and an inner edge portion extending along the length thereof, wherein the inner edge portions of the first and second stringer tapes are arranged to oppose one another, each said stringer tape having a multiplicity of coupling elements disposed in a row along the corresponding inner edge portion thereof, wherein the coupling elements are anchored to the edge portion and project beyond it to define corresponding coupling element receiving recesses therebetween; and a slider captively engaged with opposed rows of coupling elements of the first and second stringer tapes for reciprocal movement therealong, for bringing the coupling elements of the first stringer tape into and out of interlocking interengagement between pairs of adjacent coupling elements on the second stringer tape and vice versa as parts of the slide fastener are brought into closed and open conditions respectively;

characterised in that the slide fastener is provided with:

an elongate web of water-resistant film which extends longitudinally of at least one face of each of the first and second stringer tapes at least along a coupling element anchoring zone thereof and across at least a root portion of said coupling element receiving recesses defined between neighbouring coupling elements, beyond the inner edge portion of the stringer tapes, so as to provide film web portions between said neighbouring coupling elements, which web portions abut against and conform about at least a front end face of the respective coupling element interlocked between said neighbouring coupling elements when the slide fastener is in the closed condition so that the web portions form a water-resistant seal against the front end faces of the coupling elements abutting thereagainst; and a layer of adhesive material provided between at least the coupling element anchoring zone and the film, and between the film and a face of the row of coupling elements adjacent at least the root portion of said recesses.

12. A slide fastener as claimed in claim 11 wherein said adhesive is selected from the group of adhesives including a thermal bonding adhesive; a contact adhesive; and a hot melt adhesive.

13. A slide fastener as claimed in claim 11 wherein said adhesive material is selected from the group including a hot melt adhesive or hot melt contact adhesive.

14. A slide fastener suitable for providing a water-resistant closure between two edges of material wherein the fastener comprises:

first and second stringer tapes, each stringer tape having an upper and a lower surface, and an inner edge portion extending along the length thereof, wherein the inner edge portions of the first and second stringer tapes are arranged to oppose one another;

each said stringer tape having a multiplicity of coupling elements disposed in a row along the corresponding inner edge portion thereof, wherein the coupling elements are anchored to the edge portion and project beyond it to define corresponding coupling element receiving recesses therebetween; and a slider captively engaged with opposed rows of coupling elements of the first and second stringer tapes for reciprocal movement therealong, for bringing the coupling elements of the first stringer tape into and out of interlocking interengagement between pairs of adjacent coupling elements on the second stringer tape and vice versa as parts of the slide fastener are brought into closed and open conditions respectively;

characterised in that the slide fastener is provided with:

an elongate web of water-resistant film which extends longitudinally of at least one face of each of the first and second stringer tapes at least along a coupling element anchoring zone thereof and across at least a root portion of said coupling element receiving recesses defined between neighbouring coupling elements, beyond the inner edge portion of the stringer tapes, so as to provide film web portions between said neighbouring coupling elements, which web portions abut against and conform about at least a front end face of the respective coupling element interlocked between said neighbouring coupling elements when the slide fastener is in the closed condition so that the web portions form a water-resistant seal against the front end faces of the coupling elements abutting thereagainst; and two layers of adhesive—one on the film and one on the anchoring zone/stringer tape.

15. A slide fastener suitable for providing a water-resistant closure between two edges of material wherein the fastener comprises:

first and second stringer tapes, each stringer tape having an upper and a lower surface, and an inner edge portion extending along the length thereof, wherein the inner edge portions of the first and second stringer tapes are ranged to oppose one another;

each said stringer tape having a multiplicity of coupling elements disposed in a row along the corresponding inner edge portion thereof, wherein the coupling elements are anchored to the edge portion and project beyond it to define corresponding coupling element receiving recesses therebetween; and a slider captively engaged with opposed rows of coupling elements of the first and second stringer tapes for reciprocal movement therealong, for bringing the coupling elements of the first stringer tape into and out of interlocking interengagement between pairs of adjacent coupling elements on the second stringer tape and vice versa as parts of the slide fastener are brought into closed and open conditions respectively;

characterised in that:

the slide fastener is provided with an elongate web of water-resistant film which extends longitudinally of at least one face of each of the first and second stringer tapes at least along a coupling element anchoring zone thereof and across at least a root portion of said coupling element receiving recesses defined between neighbouring coupling elements, beyond the inner edge portion of the stringer tapes, so as to provide film web portions between said neighbouring coupling elements, which web portions abut against and conform about at least a front end face of the respective coupling element interlocked between said neighbouring coupling elements when the slide fastener is in the closed condition so that the web portions form a water-resistant seal against the front end faces of the coupling elements abutting thereagainst, said film is bonded to the stringer tapes and coupling elements by an adhesive material disposed in at least one layer therebetween.

16. A method of producing a water-resistant slide fastener, the method comprising the steps of:

(a) providing a slide fastener comprising first and second stringer tapes, each stringer tape having a multiplicity of coupling elements in a row extending along an inner edge portion thereof;

(b) providing a length of water-resistant film;

(c) aligning the film along the stringer tape and row of coupling elements so that the film extends over the coupling element anchoring zone and the faces of the coupling elements adjacent the recess root portions; and (d) bringing the coupling element anchoring zone of the stringer tape and the faces of the coupling elements adjacent the recess root portions together with the film and bonding the film to form web portions extending between neighbouring coupling elements across and inside at least the root portions of said recesses, so that when the slide fastener is closed in use thereof, the front faces of the coupling elements abut against and deform said film web portions to form a water-resistant seal against the front faces of the coupling elements;

(e) aligning the respective inner edge portions of the first and second stringer tapes to oppose one another;

(f) providing a slider; and (g) mounting the slider on the rows of coupling elements such that the slider is captively engaged therewith for reciprocal movement therealong.

17. A method of producing a water resistant slide fastener as claimed in claim 16, which includes the steps of: providing at least one layer of hot melt adhesive on a face of the water resistant film; and applying heat to at least one of the stringer elements and the water resistant film, before applying each length of film to the stringer tapes and the coupling elements, anchored thereto.

18. A method as claimed in claim 16 which includes the further step, after the film has been applied to the stringer tapes and the coupling elements, of passing the slide fastener through a former tool which presses the film into contact with the stringer tapes and the coupling elements.

19. A method of manufacturing a stringer tape suitable for use in a water-resistant slide fastener comprising the steps of:

1) providing a stringer tape having a multiplicity of coupling elements—arranged in a row along an inner edge portion thereof, wherein the stringer tape comprises a coupling element anchoring zone and adjacent coupling elements have coupling element receiving recesses defined therebetween and each coupling element receiving recess has a root portion adjacent said inner edge portion;

2) providing a length of water-resistant film;

3) aligning the film along the stringer tape and row of coupling elements so that the film extends over the coupling element anchoring zone and the faces of the coupling elements adjacent the recess root portions; and 4) bringing the coupling element anchoring zone of the stringer tape and a face of each of the coupling elements adjacent the recess root portions together with the film the adhesive material and bonding the film to the stringer tape and the faces of the coupling elements to form web portions extending between neighbouring coupling elements at least the root portion of said recesses, so that when the slide fastener is closed in use thereof the front faces of the coupling elements abut against and deform said film web portions to form a water-resistant seal against the front faces of the coupling elements.

* * * * *